US008305370B2

(12) United States Patent
Song et al.

(10) Patent No.: US 8,305,370 B2
(45) Date of Patent: Nov. 6, 2012

(54) ORGANIC LIGHT EMITTING DISPLAY, CONTROLLER THEREFOR AND ASSOCIATED METHODS

(75) Inventors: June-young Song, Suwon-si (KR); Young-jong Park, Suwon-si (KR); Jang-doo Lee, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 1289 days.

(21) Appl. No.: 12/071,432

(22) Filed: Feb. 21, 2008

(65) Prior Publication Data

US 2008/0204438 A1 Aug. 28, 2008

(30) Foreign Application Priority Data

Feb. 23, 2007 (KR) ..... 10-2007-0018701

(51) Int. Cl.
*G09G 5/00* (2006.01)

(52) U.S. Cl. ..... 345/207; 345/76; 345/77

(58) Field of Classification Search ..... None
See application file for complete search history.

(56) References Cited

U.S. PATENT DOCUMENTS

| | | | | |
|---|---|---|---|---|
| 5,315,694 | A | 5/1994 | Kasano | |
| 6,337,675 | B1 | 1/2002 | Toffolo et al. | |
| 6,836,074 | B2 | 12/2004 | Nakamura | |
| 7,304,654 | B2 | 12/2007 | Mori et al. | |
| 7,369,183 | B2 * | 5/2008 | Oka et al. | 348/674 |
| 7,952,540 | B2 * | 5/2011 | Lee | 345/76 |
| 8,022,902 | B2 * | 9/2011 | Lee | 345/76 |
| 8,094,098 | B2 * | 1/2012 | Lee | 345/77 |
| 2003/0210256 | A1 | 11/2003 | Mori et al. | |
| 2003/0218583 | A1 | 11/2003 | Hasagawa | |
| 2005/0057191 | A1 * | 3/2005 | Jo et al. | 315/291 |
| 2005/0219179 | A1 | 10/2005 | Kim | |
| 2006/0055335 | A1 | 3/2006 | Shingai et al. | |
| 2006/0055828 | A1 | 3/2006 | Henry et al. | |
| 2006/0164408 | A1 * | 7/2006 | Nishikawa et al. | 345/207 |
| 2006/0244697 | A1 * | 11/2006 | Lee et al. | 345/77 |
| 2007/0165048 | A1 | 7/2007 | Yamashita et al. | |
| 2007/0188623 | A1 | 8/2007 | Yamashita et al. | |
| 2008/0174607 | A1 * | 7/2008 | Iranli | 345/589 |

FOREIGN PATENT DOCUMENTS

| | | | |
|---|---|---|---|
| EP | 1 717 788 | A2 | 11/2006 |
| JP | 05-207398 | A | 8/1993 |
| JP | 2001-309280 | A | 11/2001 |
| JP | 2002-055675 | A | 2/2002 |

(Continued)

*Primary Examiner* — Amare Mengistu
*Assistant Examiner* — Jennifer Zubajlo
(74) *Attorney, Agent, or Firm* — Lee & Morse, P.C.

(57) ABSTRACT

A display driven by a data signal and a light emission signal may be controlled by a control system including a first through fourth controller. The first controller may select a gamma value in accordance with ambient illumination and output a corresponding gamma compensation signal to control a gradation voltage of input image data. The second controller may compare the ambient illumination with a reference value, generate a selection signal in response thereto, and provide changed image data obtained by changing input image data in accordance with the selection signal as the data signal. The third controller may apply a scaling factor to the input image data generated from extracted features related to the input image data and a scale ratio obtained from the extracted features, and output scaled image data as the data signal. The fourth controller may control a pulse width of the emission control signal.

20 Claims, 14 Drawing Sheets

FOREIGN PATENT DOCUMENTS

| | | | |
|---|---|---|---|
| JP | 2002-189449 | | 7/2002 |
| JP | 2004-096760 | | 3/2004 |
| JP | 2004-151557 | A | 5/2004 |
| JP | 2005-070426 | A | 3/2005 |
| JP | 2006-003874 | A | 1/2006 |
| JP | 2006-243454 | A | 9/2006 |
| JP | 2006-309127 | A | 11/2006 |
| JP | 2006-309133 | A | 11/2006 |
| JP | 2006-337997 | A | 12/2006 |
| JP | 2006-349909 | A | 12/2006 |
| JP | 2007-025317 | A | 2/2007 |
| JP | 2007-047791 | A | 2/2007 |
| JP | 2008-209881 | A | 9/2008 |
| KR | 10-1990-0003762 | A | 3/1990 |
| KR | 10-54440 | B1 | 9/1992 |
| KR | 10-2005-0063395 | A | 6/2005 |
| KR | 10-2006-0012738 | A | 2/2006 |
| KR | 10-2006-0035831 | A | 5/2006 |
| KR | 10-2006-0050027 | A | 5/2006 |
| KR | 10-2006-0113009 | A | 11/2006 |
| KR | 10-2006-0120643 | A | 11/2006 |
| WO | WO 2004/055769 | A1 | 7/2004 |

* cited by examiner

FIG. 7A $$A\begin{bmatrix} R_{in} \\ G_{in} \\ B_{in} \end{bmatrix} = \begin{bmatrix} R_s \\ G_s \\ B_s \end{bmatrix}$$

FIG. 7B $$A = \begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}$$

FIG. 7C $$\begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}\begin{bmatrix} R_{in} \\ G_{in} \\ B_{in} \end{bmatrix} = \begin{bmatrix} R_s \\ G_s \\ B_s \end{bmatrix}$$

FIG. 7D $$\begin{bmatrix} 0.299 & 0.587 & 0.114 \\ 0.299 & 0.587 & 0.114 \\ 0.299 & 0.587 & 0.114 \end{bmatrix}\begin{bmatrix} R_{in} \\ G_{in} \\ B_{in} \end{bmatrix} = \begin{bmatrix} R_s \\ G_s \\ B_s \end{bmatrix}$$

(a) Zonal_Para = 0.5 (b) Zonal_Para = 0.8

FIG. 13

722

| Upper 5 bit value | Emission rate | Emission ratio | Luminance | Emission control signal width |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 100% | 300 | 325 |
| 6 | 22% | 100% | 300 | 325 |
| 7 | 25% | 100% | 300 | 325 |
| 8 | 29% | 100% | 300 | 325 |
| 9 | 33% | 100% | 300 | 325 |
| 10 | 36% | 100% | 300 | 325 |
| 11 | 40% | 99% | 297 | 322 |
| 12 | 43% | 98% | 295 | 320 |
| 13 | 47% | 96% | 287 | 311 |
| 14 | 51% | 93% | 280 | 303 |
| 15 | 54% | 89% | 268 | 290 |
| 16 | 58% | 85% | 255 | 276 |
| 17 | 61% | 81% | 242 | 262 |
| 18 | 65% | 76% | 228 | 247 |
| 19 | 69% | 72% | 217 | 235 |
| 20 | 72% | 69% | 206 | 223 |
| 21 | 76% | 65% | 196 | 212 |
| 22 | 79% | 62% | 186 | 202 |
| 23 | 83% | 60% | 179 | 194 |
| 24 | 87% | 57% | 172 | 186 |
| 25 | 90% | 55% | 165 | 179 |
| 26 | 94% | 53% | 159 | 172 |
| 27 | 98% | 51% | 152 | 165 |
| 28 | – | – | – | – |
| 29 | – | – | – | – |
| 30 | – | – | – | – |
| 31 | – | – | – | – |

ORGANIC LIGHT EMITTING DISPLAY, CONTROLLER THEREFOR AND ASSOCIATED METHODS

BACKGROUND OF THE INVENTION

1. Field of the Invention

Embodiments of the present invention relate to an organic light emitting display. More particularly, embodiments relate to an organic light emitting display capable of reducing power consumption and/or improving the visibility of a field, a controller therefore, and associated methods.

2. Description of the Related Art

Flat panel displays, e.g., liquid crystal displays (LCD), field emission displays (FED), plasma display panels (PDP), organic light emitting displays, and so forth, may be advantageous in having reduced weight and volume, small thickness, and excellent color reproducibility, as compared to cathode ray tube (CRT) displays. Accordingly, such flat panel displays may be used in, e.g., personal digital assistants (PDAs), MP3 players, digital still cameras (DSCs), portable phones, and so forth.

Organic light emitting displays may include an organic light emitting diode (OLED) between electrodes, so application of voltage to the electrodes may cause re-combination of electrons and holes in the OLED, thereby emitting light to form images. Emission of light from the OLED may be controlled by an amount of current therethrough. For example, emission of bright light by the OLED may require a relatively large amount of current therethrough.

However, use of a large amount of current through the OLED may trigger high power consumption by the organic light emitting display. Further, reduction of power consumption of the organic light emitting display, while using high current through the OLED, may require decrease of a drive voltage of an image, thereby distorting display quality thereof, e.g., an undesirable portion of the image may become dark.

Moreover, when used in portable display devices, the organic light emitting display may be exposed to various environments. Thus, the visibility of the image displayed on the portable display device may be changed according to an ambient environment, e.g., ambient illumination. In particular, the visibility in the image on the portable display device may be extremely reduced in environments, e.g., sunlight, that are brighter than the image on the display.

Therefore, there is a need for a portable display device, in particular, an organic light emitting display, having improved visibility in bright ambient environments.

SUMMARY OF THE INVENTION

Embodiments of the present invention are therefore directed to an organic light emitting display, a controller therefor, and associated methods, which substantially overcome one or more of the disadvantages of the related art.

It is therefore a feature of an embodiment of the present invention to provide an organic light emitting display capable of reducing power consumption, a controller therefor, and associated methods.

It is therefore another feature of an embodiment of the present invention to provide an organic light emitting display capable of improving image visibility, a controller therefore, and associated methods.

At least one of the above and other features and advantages may be realized by providing an organic light emitting display including a pixel unit including a plurality scan lines configured to provide scan signals, a plurality of emission control lines configured to provide emission control signals, a plurality of data lines configured to provide data signals, and a plurality of pixels coupled to the scan lines, the emission control lines, and the data lines, a scan driver configured to sequentially generate and apply the scan signals and the emission control signals to the plurality of scan lines, a data driver configured to generate and apply the data signals to the data lines, an optical sensor configured to generate an optical sensing signal corresponding to an intensity of ambient light, a first controller configured to select a gamma value corresponding to the optical sensing signal, and output a gamma compensation signal corresponding to the selected gamma value to control a gradation voltage of the data signal, a second controller configured to compare the optical sensing signal with a previously set reference value, generate a selection signal in response thereto, and provide changed image data to the data driver, the changed data being obtained by changing input image data in accordance with the selection signal, a third controller configured to obtain and apply a scaling factor to the input image data through extracted features related to the input image data and a scale ratio obtained from the extracted features, and provide scaled image data to the data driver, and a fourth controller configured to provide a luminance control signal for controlling a pulse width of the emission control signal to the scan driver.

According to an intensity of the ambient light sensed by the optical sensor, the first controller may operate when the ambient light has an intensity less than the reference value, and the second controller may operate when the ambient light has an intensity equal to or greater than the reference value.

The data driver may receive the image data converted by one of the first controller, the second controller and the third controller to generate data signals corresponding to the image data, and transfer the generated data signals to the data lines.

Only one of the changed image data from the second controller and the scaled image data from the third controller may be selected and provided to the data driver.

The first controller may include an analog-digital converter configured to convert an analog sensing signal output from the optical sensor into a digital sensing signal, a counter configured to generate a counting signal during one frame period, a conversion processor configured to output a control signal in accordance with the digital sensing signal and the counting signal, a register generator configured to classify the digital sensing signal into a plurality of states and store a plurality of set values corresponding to respective states, a first selector configured to select and output one of the plurality of set values stored in the register generator in accordance with the control signal output by the conversion processor, and a gamma compensation circuit configured to generate a gamma compensation signal according to the one of the plurality of set values output from the first selector. The first controller may include a second selector configured to control an operational state of the first controller.

The second controller may include a comparator configured to compare the optical sensing signal with a previously set reference value and output a selection signal for selecting one of at least three modes, a controller configured to determine, in accordance with the selection signal, whether the input image data is to be changed, a first calculator configured to generate pixel saturation data corresponding to the input image data received from the controller, a second calculator configured to extract changed data in accordance with the pixel saturation data and the selection signal, and a memory configured to store the input image data received from the controller or the changed data supplied from the second calculator.

The first calculator may be configured to generate the pixel saturation data using a saturation change matrix. The first calculator may calculate input data by sub pixels included in the input image data and the saturation change matrix to obtain destination saturation data by sub pixels, and generates the pixel saturation data using the destination saturation data. A reference look-up table unit may be referred by the second calculator and include first and second saturation and luminance look-up tables. The second calculator may be configured to select one of saturation and luminance look-up tables in accordance with the pixel saturation data and the selection signal, and extract the changed data from the selected look-up tables.

The third controller may include an image analyzer adapted to analyze input image data, a scaling factor calculator adapted to generate a scaling factor with respect to the analyzed input image data, and to apply the scaling factor to the input image data to generate a scaled-down image data, and an intensity resealing unit adapted to reduce an overall intensity level of the input image data. The scaling factor calculator may include a parameter table, which stores a parameter value for determining scale intensity upon calculating a scaling factor. A selector may be configured to selectively transmit an output of the intensity rescaling unit. The image analyzer may be configured to extract luminance components from the input image data to generate a histogram. The image analyzer may be configured to transmit the histogram from the image analyzer to the intensity scaling unit and to the scaling factor calculator. The intensity resealing unit rescales a total intensity of images based on a distribution pattern of the histogram, and the scaling factor calculator uses the histogram information as a source of a parameter selection influencing each scaling factor.

The fourth controller may include a data summing unit configured to sum input image data during one frame period to generate a frame data, a look-up table configured to store information about a luminance control of the pixel unit according to a magnitude of the frame data, and a luminance control driver configured to output the luminance control signal in accordance with the information stored in the look-up table to adjust a ratio of an emission period and a non-emission period of the emission control signal.

At least one of the above and other features and advantages may be realized by providing a control system for use with a display driven by a data signal and an emission control signal, the control system including an optical sensor configured to generate an optical sensing signal corresponding to an intensity of ambient light, a first controller configured to select a gamma value corresponding to the optical sensing signal, and output a gamma compensation signal corresponding to the selected gamma value to control a gradation voltage of input image data, a second controller configured to compare the optical sensing signal with a previously set reference value, generate a selection signal in response thereto, and provide changed image data as the data signal, the changed data being obtained by changing input image data in accordance with the selection signal, a third controller configured to obtain and apply a scaling factor to the input image data through extracted features related to the input image data and a scale ratio obtained from the extracted features, and output scaled image data as the data signal, and a fourth controller configured to provide a luminance control signal for controlling a pulse width of the emission control signal.

At least one of the above and other features and advantages may be realized by providing a method of controlling a display driven by a data signal and an emission control signal, the method including generating an optical sensing signal corresponding to an intensity of ambient light, selecting a gamma value corresponding to the optical sensing signal, and outputting a gamma compensation signal corresponding to the selected gamma value to control a gradation voltage of input image data, comparing the optical sensing signal with a previously set reference value, generating a selection signal in response thereto, and providing changed image data as the data signal, the changed data being obtained by changing input image data in accordance with the selection signal, obtaining and applying a scaling factor to the input image data through extracted features related to the input image data and a scale ratio obtained from the extracted features, and outputting scaled image data as the data signal, and controlling a pulse width of the emission control signal.

BRIEF DESCRIPTION OF THE DRAWINGS

The above and other features and advantages of the present invention will become more apparent to those of ordinary skill in the art by describing in detail exemplary embodiments thereof with reference to the attached drawings, in which:

FIG. 7A to FIG. 7D illustrate an example calculating destination saturation data by sub pixels using a saturation change matrix by a first calculator shown in FIG. 6 according to an embodiment;

FIG. 13 illustrates the look-up table shown in FIG. 12 according to an embodiment.

DETAILED DESCRIPTION OF THE INVENTION

Figure 1:
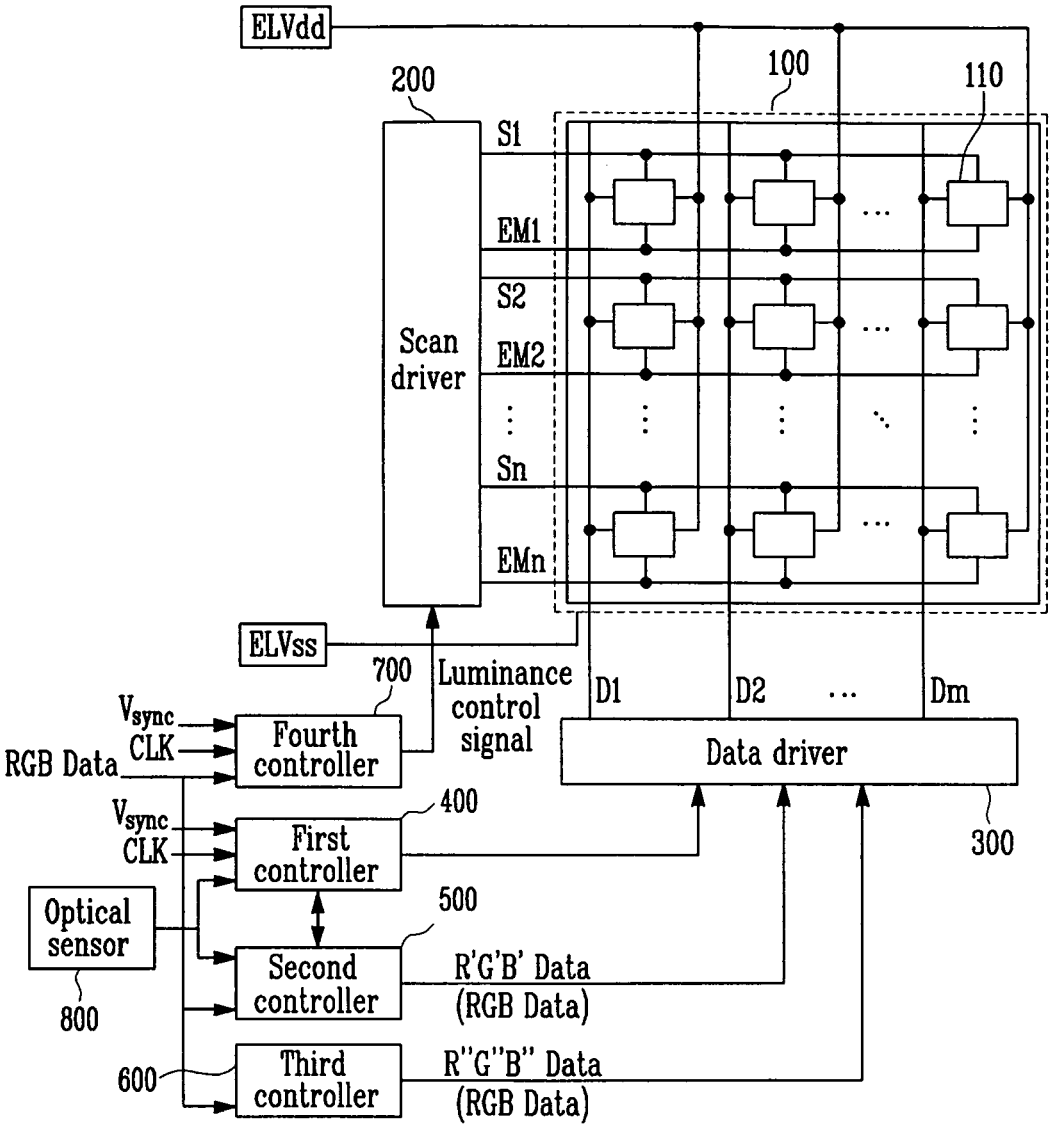
FIG. 1 illustrates a block diagram of an organic light emitting display according to an embodiment of the present invention.

Korean Patent Application No. 10-2007-0018701, filed on Feb. 23, 2007, in the Korean Intellectual Property Office, and entitled: "Organic Light Emitting Display, Driver Therefore, and Associated Methods," is incorporated by reference herein in its entirety.

Embodiments of the present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

FIG. 1 illustrates a block diagram of an organic light emitting display according to an embodiment of the present invention. With reference to FIG. 1, the organic light emitting display may include a pixel unit 100, a scan driver 200, a data driver 300, first to fourth controllers 400, 500, 600, and 700, and an optical sensor 800. The organic light emitting display may include an OLED.

The pixel unit 100 may include a plurality of pixels 110, which are coupled to scan lines S1 to Sn, emission control lines EM1 to EMn, and data lines D1 to Dm. Each of the pixels 110 may include an OLED, and may be composed of at least two sub pixels for emitting light of different colors. The pixel unit 100 may display images according to a first voltage ELVdd and a second voltage ELVss supplied from external power sources, a scan signal and an emission control signal supplied from the scan driver 200, and a data signal supplied from the data driver 300.

The scan driver 200 may generate the scan signal and the emission control signal. The scan signal generated by the scan driver 200 may be sequentially provided to respective scan lines S1 to Sn. The emission control signal generated by the scan driver 200 may be sequentially provided to respective emission control lines EM1 to EMn. The emission control signal may be controlled by a luminance control signal provided from the fourth controller 700. An entire brightness in the pixel unit 100 may be adjusted according to a pulse width change in the controlled emission control signal.

The data driver 300 may receive image data converted by at least one of the second and third controllers 500, and 600, and may generate a corresponding data signal. The data signal generated by the data driver 300 may be supplied to the data lines D1 to Dm in synchronization with the scan signal to be transferred to each pixel 110.

The optical sensor 800 may include a transistor or an optical sensing device, such as a photo diode, which senses the intensity of ambient light and generates an optical sensing signal Ssens. The optical sensing signal Ssens generated by the optical sensor 800 may be provided to the first controller 400 and/or the second controller 500.

The first controller 400 may generate a sensing signal corresponding to a the optical sensing signal Ssens from the optical sensor 800, select a gamma value according to the sensing signal, and output a gamma compensation signal corresponding to the selected gamma value. Thus, the first controller 400 may adjust a gradation voltage of the data signal, thereby controlling a brightness of the pixel unit 100.

When reducing a drive voltage of an image, so as to reduce power consumption of the organic light emitting display in which an emission degree changes according to a change of a current amount, part of the image may become dark, degrading image quality. The first controller 400 may solve the aforementioned problems by adjusting the gradation voltage.

The second controller 500 may compare the optical sensing signal Ssens from the optical sensor 800 with a previously set reference value and generate a selection signal for selecting one of at least three modes according to a comparison result. The second controller 500 may store input image data RGB Data and changed data R'G'B' Data. The changed data R'G'B' Data may be obtained by changing the input image data RGB Data.

In detail, the second controller 500 may determine how the input image data RGB Data is to be changed according to the optical sensing signal Ssens from the optical sensor 800, and generate and store changed data R'G'B' Data. Here, the changed data R'G'B' Data may be obtained by changing a luminance value and/or saturation value of the input image data RGB Data. When changing the input image data RGB Data, the second controller 500 may apply at least two modes corresponding to the selection signal to generate the changed data R'G'B' Data. The changed data R'G'B' Data or the input image data RGB Data may then be provided to the data driver 300.

When ambient illumination is equal to or greater than the reference value, e.g., sunlight, the second controller 500 may generate the changed data R'G'B' Data in order to improve visibility of the image on the display. The changed data R'G'B' Data may be obtained by increasing a saturation of the input image data RGB Data. When generating the changed data R'G'B' Data, one of at least two modes, determined in accordance with ambient illumination, for controlling a change of the input image data RGB Data may be selected to generate the change data R'G'B' Data.

When the ambient illumination is less than the reference value, the first controller 400 may operate. When the ambient illumination is equal to or greater than the reference value, the second controller 500 may operate.

The third controller 600 may generate and apply a scaling factor to the input image data RGB Data through extraction of features related to the input image data RGB Data and a scale ratio obtained from the extracted features, and transfer the scaled image data R"G"B" Data to the data driver 300. Only one of the second controller 500 and the third controller 600 may operate at one time, so that only one of the changed data R'G'B' Data output by the second controller 500 and the scaled data R"G"B" Data output by the third controller 600 is provided to the data driver 300.

The fourth controller 700 may provide a luminance control signal for adjusting a pulse width of an emission control signal from the scan driver 200 to scan lines S1 to Sn. The fourth controller 700 may adjust an amount of an electric current flowing to the pixel unit 100 and prevent an electric current greater than a predetermined set value from flowing to the pixel unit 100, thereby adjusting luminance of the entire pixel unit 100.

The organic light emitting display described above may provide reduced power consumption and/or improved visibility by operation of one or more of the first to fourth controllers 400, 500, 600, and 700. A detailed construction and operation of the first to fourth controllers 400, 500, 600, and 700 will be explained in detail with reference to the accompanying drawings.

Figure 2:
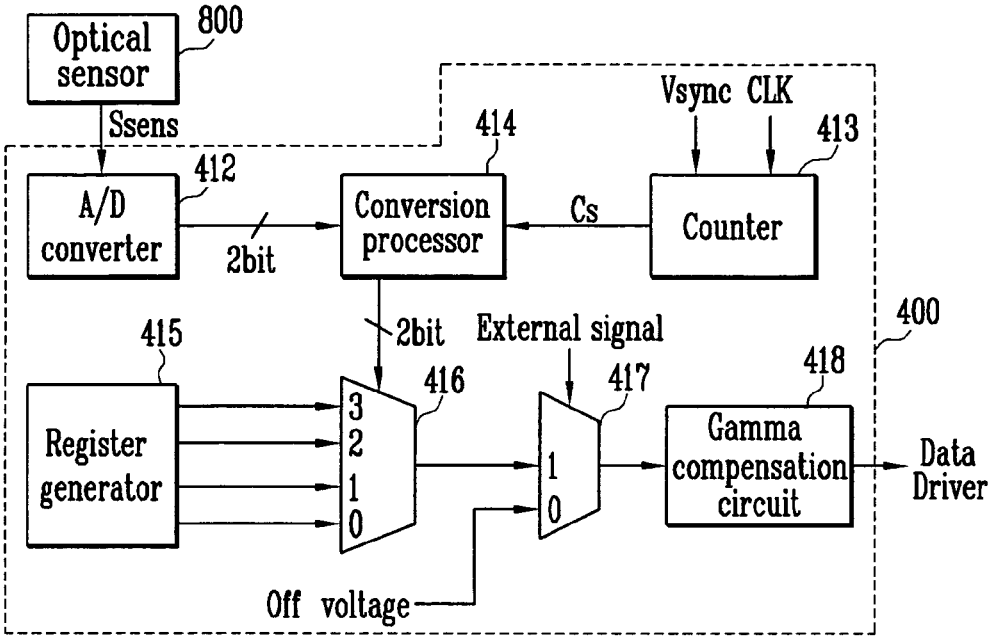
FIG. 2 illustrates a block diagram of the first controller shown in FIG. 1 according to an embodiment.

FIG. 2 illustrates a block diagram of the first controller 400 shown in FIG. 1 in accordance with an embodiment. With reference to FIG. 2, the first controller 400 may include an A/D converter 412, a counter 413, a conversion processor 414, a register generator 415, a first selector 416, a second selector 417, and a gamma compensation circuit 418.

The A/D converter 412 may compare the optical sensing signal Ssens from the optical sensor 800 with a set reference voltage, and output a corresponding digital sensing signal. For example, ambient illumination may be divided into first through fourth illumination states of decreasing illumination and may be characterized by 2-bit data. The A/D converter 412 may output a sensing signal of '11' when ambient light is in the first, i.e., brightest, illumination state. The A/D converter 412 may output a sensing signal of '10' when ambient light is in a second illumination state. The A/D converter 412 may output a sensing signal of '01' when ambient light is in a third illumination state. The A/D converter 412 may output a sensing signal of '00' when ambient light is in the fourth, i.e., darkest, illumination state.

The counter 413 may count a predetermined number for a predetermined time according to externally supplied vertical synchronous signal Vsync and output a counting signal Cs. When the counter 413 is a 2-bit counter, the counter 413 may be initialized with '0' when the vertical synchronous signal Vsync is input thereto, and may sequentially shifts a clock signal CLK to count to '11'. Through the aforementioned operation, the counter 413 may sequentially count from '00' to '11' during one frame period, and output the counting signal Cs corresponding to the counted number to the conversion processor 414.

The conversion processor 414 may output a control signal to select a set value of each register using the counting signal Cs from the counter 413 and the digital sensing signal from the A/D converter 412. The conversion processor 414 may output the control signal corresponding to the digital sensing signal and maintain the control signal during one frame period as determined by the counter 413. During a next frame period, the conversion processor 414 may reset the control signal to be output, and output and maintain the control signal corresponding to the digital sensing signal from the A/D converter 412 during the next frame period.

For example, when the ambient light is in the first or brightest state, the conversion processor 414 may output a control signal corresponding to the digital sensing signal '11' and maintain the control signal during one frame period while the counter 413 counts. When the ambient light is in the fourth or darkest state, the conversion processor 414 may output a control signal corresponding to the digital sensing signal '00' and maintain the control signal during one frame period while the counter 413 counts. In the same manner, when the ambient light in the second or bright state, or in the third or dark state, the conversion processor 414 may output the control signal corresponding to the sensing signal '10' or '01', respectively, and maintain the control signal during one frame period while the counter 413 counts.

The register generator 415 may divide a brightness of ambient light into a plurality of stages and store a plurality of register set values corresponding to respective stages. The first selector 416 may select a register set value among the plurality of register set values stored in the register generator 415 according to the control signal set by the conversion processor 414. The second selector 417 may receive an externally supplied 1-bit signal for controlling on/off state of the first controller 400. When the second selector 417 selects '1', the first controller 400 may operate. When the second selector 417 selects '0', the first controller 400 may be turned off, so that the brightness may be selectively controlled according to ambient light.

The gamma compensation circuit 418 may generate a plurality of gamma compensation signals corresponding to a register set value selected according to the control signal set by the conversion processor 414. Since the control signal corresponds to the optical sensing signal Ssens output from the optical sensor 800, the gamma compensation signal has a different value according to the ambient illumination.

Figure 3:
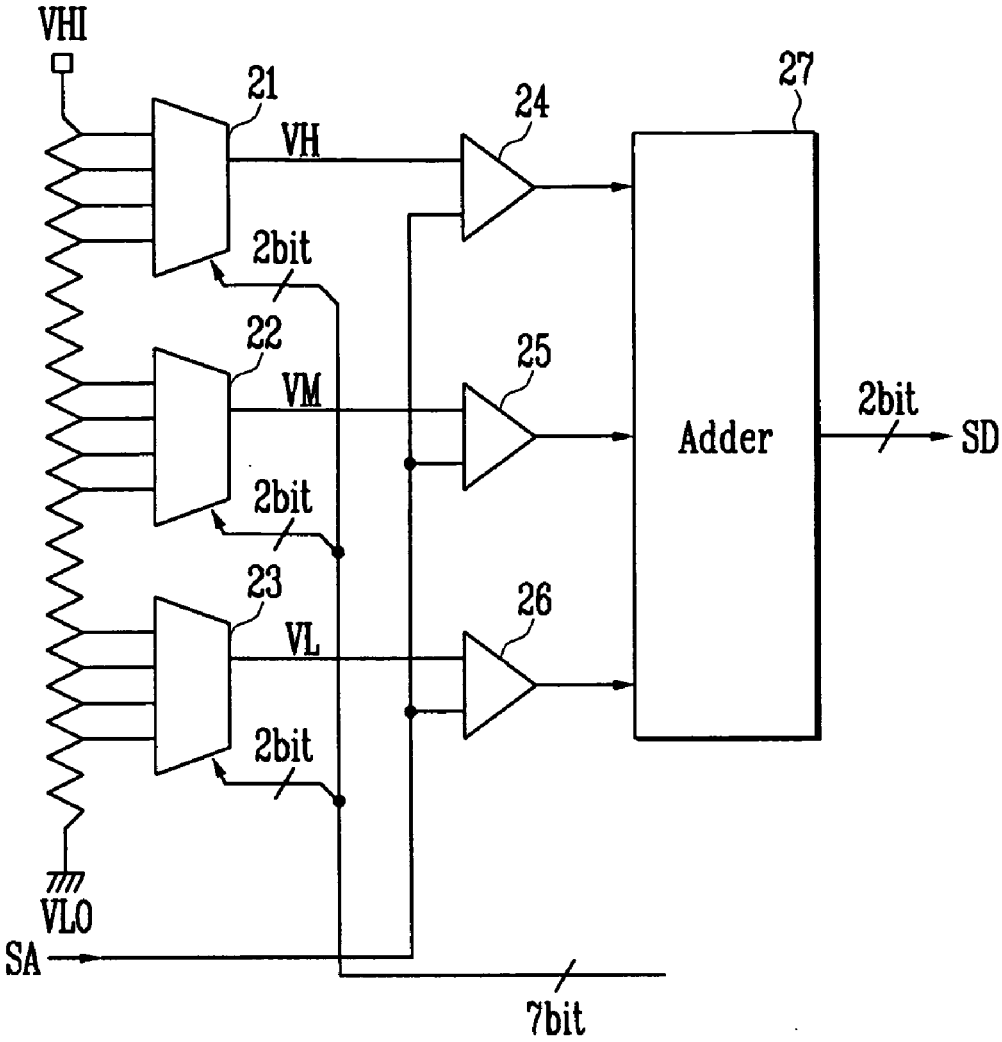
FIG. 3 illustrates a schematic view of the A/D converter shown in FIG. 2 according to an embodiment.

FIG. 3 illustrates an A/D converter 412 shown in FIG. 2 in accordance with an embodiment. With reference to FIG. 3, the A/D converter 412 may include first to third selectors 21, 22, and 23, first to third comparators 24, 25, and 26, and an adder 27.

The first to third selectors 21, 22, and 23 may receive a plurality of gradation voltages VHI to VLO divided through a plurality of resistor rows for generating a plurality of gradation voltages VHI to VLO, and output gradation voltages corresponding to different set values of 2 bits, which are referred to as 'reference voltages VH to VL'.

The first comparator 24 may compare an analog sensing signal SA, i.e., the optical sensing signal Ssens, with a first reference signal VH and output a comparison result. For example, when the analog sensing signal SA is greater than the first reference signal VH, the first comparator 24 outputs '1'. When the analog sensing signal SA is less than or equal to the first reference signal VH, the first comparator 24 outputs '0'.

In the same manner, the second comparator 25 may compare the analog sensing signal SA with a second reference signal VM and output a comparison result. The third comparator 26 may compare an analog sensing signal SA with a third reference signal VL and output a comparison result. By changing the first to third reference voltages VH to VL, a range of analog sensing signals SA corresponding to a digital sensing signal SD may be altered. The adder 27 may add all output values of the first to third comparators 24 to 26 to output a 2-bit digital sensing signal SD.

Operation the A/D converter 412 in FIG. 3 will be explained assuming that the first reference voltage VH is 3V, the second reference voltage VM is 2V, the third reference voltage VL is 1V, and the greater a voltage value of the analog sensing signal SA is, the brighter the ambient light. When the analog sensing signal SA is less than 1V, the first to third comparators 24 to 26 output '0', '0', and '0', respectively. Accordingly, the adder 27 outputs a digital sensing signal SD of '00'. When the analog sensing signal SA is between 1V and 2V, the first to third comparators 24 to 26 output '0', '0', and '1', respectively. Accordingly, the adder 27 outputs a digital sensing signal SD of '01'. When the analog sensing signal SA is between 2V and 3V, the first to third comparators 24 to 26 output '0', '1', and '1', respectively. Accordingly, the adder 27 outputs a digital sensing signal SA of '10'. When the analog sensing signal SA is greater than 3V, the first to third comparators 24 to 26 output '1', '1', and '1', respectively. Accordingly, the adder 27 outputs a digital sensing signal SA of '11'. The A/D converter 212 may operate in the aforementioned manner to divide ambient illumination into the four states discussed above. In detail, the A/D converter 212 may output '00' in the fourth or darkest state, '01' in the third or dark state, '10' in the second or bright stage, and '11' in the first or brightest state.

Figure 4:
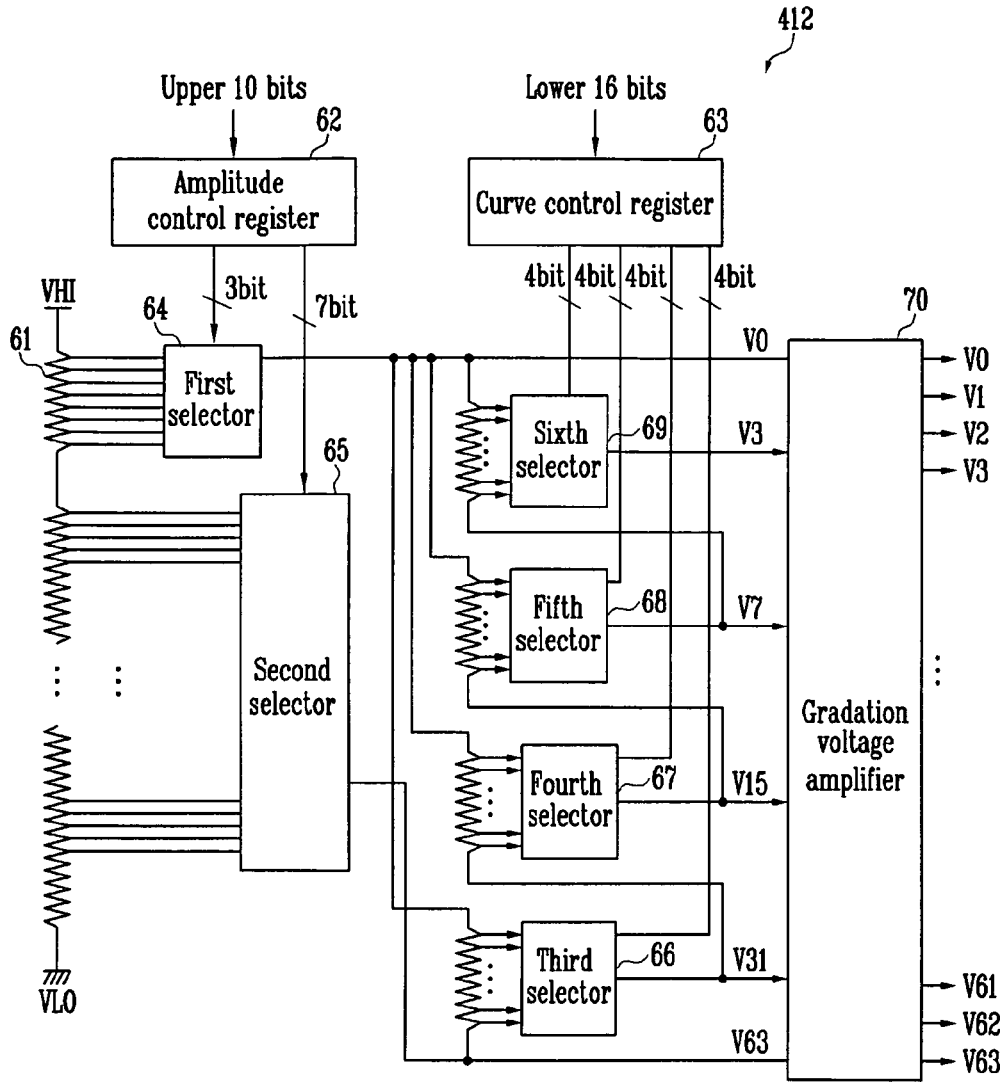
FIG. 4 illustrates the gamma compensation circuit shown in FIG. 2 according to an embodiment.

FIG. 4 illustrates the gamma compensation circuit 418 shown in FIG. 2 according to an embodiment. With reference to FIG. 4, the gamma compensation circuit 418 may include a ladder resistor 61, an amplitude control register 62, a curve control register 63, a first selector 64 to a sixth selector 69, and a gradation voltage amplifier 70.

An externally supplied highest level voltage VHI may be defined as a reference voltage. The ladder resistor 61 may include a plurality of variable resistors coupled between a lowest level voltage VLO and the reference voltage in series. A plurality of gradation voltages may be generated by the ladder resistor 61. When a resistance of the ladder resistor 61 decreases, an amplitude control range decreases, but control precision increases. When a resistance of the ladder resistor 61 increases, an amplitude control range increases, but control precision decreases.

The amplitude control register 62 may output a register set value of 3 bits to the first selector 64, and a register set value of 7 bits to the second selector 65. Here, an increase in the set bit number increases the gradation number to be selected. A change in the register set value causes a gradation voltage to be differently selected.

The curve control register 63 may output a register set value of 4 bits to each of the third selector 66 to the sixth selector 69, respectively. Here, the register set value may be changed. Further, a gradation voltage to be selected may be controlled according to the register set value.

Upper 10-bits among register values generated by the register generator 415 may be input to the amplitude control register 62. Lower 16 bits thereof may be input to the curve control register 63 to be selected as a register set value.

The first selector 64 may select a gradation voltage among the plurality of gradation voltages divided through the ladder resistor 61 corresponding to the register set value of 3 bits set by the amplitude control register 62. The selected gradation voltage output by the first selector 64 may be the most significant gradation voltage.

The second selector 65 may select a gradation voltage among the plurality of gradation voltages divided through the ladder resistor 61 corresponding to the register set value of 7-bits set by the amplitude control register 62. The selected gradation voltage output by the second selector 65 may be the least significant gradation voltage.

The third selector 66 divides a voltage between the gradation voltage output from the first selector 64 and the gradation voltage output from the second selector 65. The fourth selector 67 divides a voltage between the gradation voltage output from the first selector 64 and the gradation voltage output from the third selector 66. The fifth selector 68 selects and outputs a gradation voltage among a plurality of gradation voltages between the first selector 64 and the fourth selector 67. The sixth selector 69 selects and outputs a gradation voltage among a plurality of gradation voltages between the first selector 64 and the fifth selector 68.

Through the aforementioned operation, slope of an intermediate portion of a gradation curve may be adjusted according to a register set value of the curve control register 63, so that gamma characteristics may easily adjusted in accordance with individual sub-pixel features. When a small gradation is displayed, a potential difference between gradations may be increased, making the gamma curve downwardly convex. When a large gradation is displayed, a potential difference between gradations may be increased, making gamma curve upwardly convex.

The gradation voltage amplifier 37 may output a plurality of gradation voltages corresponding to each of a plurality of gradations displayed on the pixel unit 100. FIG. 4 shows an output of gradation voltages V0 to V63 corresponding to 64 gradations.

In the aforementioned operation, variations in characteristics of R, G, and B OLEDs may be compensated. For example, gamma compensation circuits may be installed by R, G, and B groups to substantially or completely equalize respective luminance characteristics. Thus, an amplitude and a curve of the gamma curve may be different for R, G, and B OLEDs using the curve control register 63 and the amplitude control register 62.

Figure 5A:
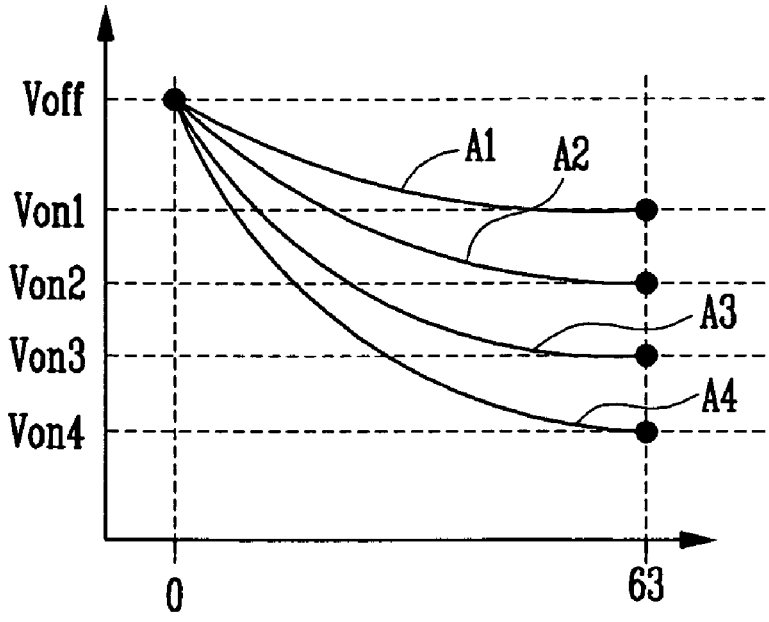
FIG. 5A and FIG. 5B illustrate gamma curves according to the gamma compensation circuit shown in FIG. 4.
Figure 5B:
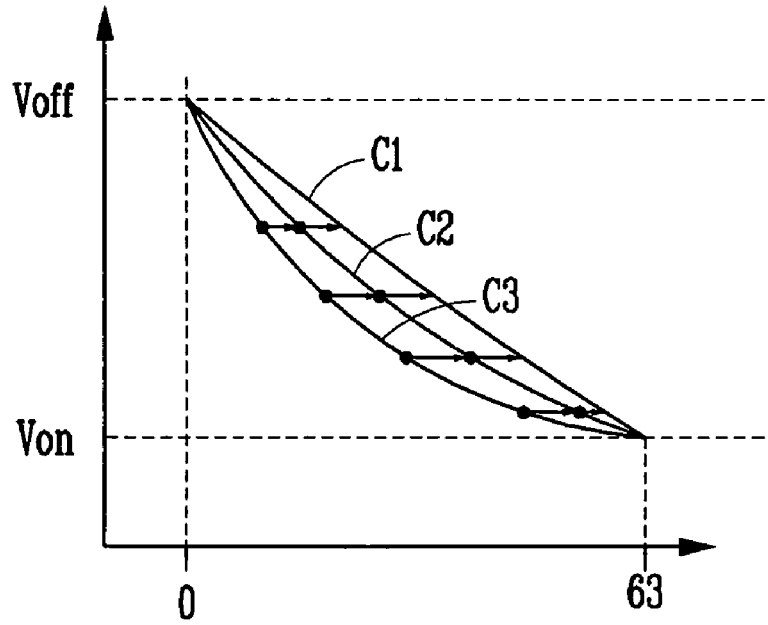

FIG. 5A and FIG. 5B illustrate gamma curves output by the gamma compensation circuit shown in FIG. 4 in accordance with an embodiment.

FIG. 5A shows gamma curves that change a lower level gradation voltage according to a register set value of 7-bits without changing an upper level gradation voltage in order to adjust the amplitude of the lower level gradation voltage. Gamma curve A1 corresponds to the first state, i.e., brightest ambient illumination. Gamma curve A2 corresponds to the third state, i.e., dark ambient illumination. Gamma curve A3 corresponds to the second state, i.e., bright ambient illumination. Gamma curve A4 corresponds to the fourth state, i.e., darkest ambient illumination.

Referring back to FIG. 4, in order to reduce an amplitude voltage of a gradation voltage, a register set value of the amplitude control register 62 may be adjusted so that the second selector 65 selects the highest level voltage VHI. In order to increase the amplitude voltage of a gradation voltage, the second selector 65 may select the lowest level voltage VLO.

FIG. 5B shows gamma curves that change only a gradation voltage of a middle level without changing the upper level gradation voltage and the lower level gradation voltage according to a register set value set by the curve control register 63. When a register set value of 4-bits is input to the third selector 66 to the sixth selector 69, they select fourth gamma values corresponding to a register set value to generate a gamma curve. An off voltage Voff is a voltage corresponding to a black gradation (gradation value of 0), and an on voltage Von is a voltage corresponding to a white gradation (gradation value of 63). A slope change degree of reference numeral C2 curve is greater than a slope change degree of a curve corresponding to C1, but is less than that of a C3 curve.

A set value of a gamma control register may be changed as illustrated in FIG. 5A and FIG. 5B to change a gradation voltage, thereby generating a gamma curve. Accordingly, brightness of each pixel 110 in the pixel unit 100 may be adjusted.

Figure 6:
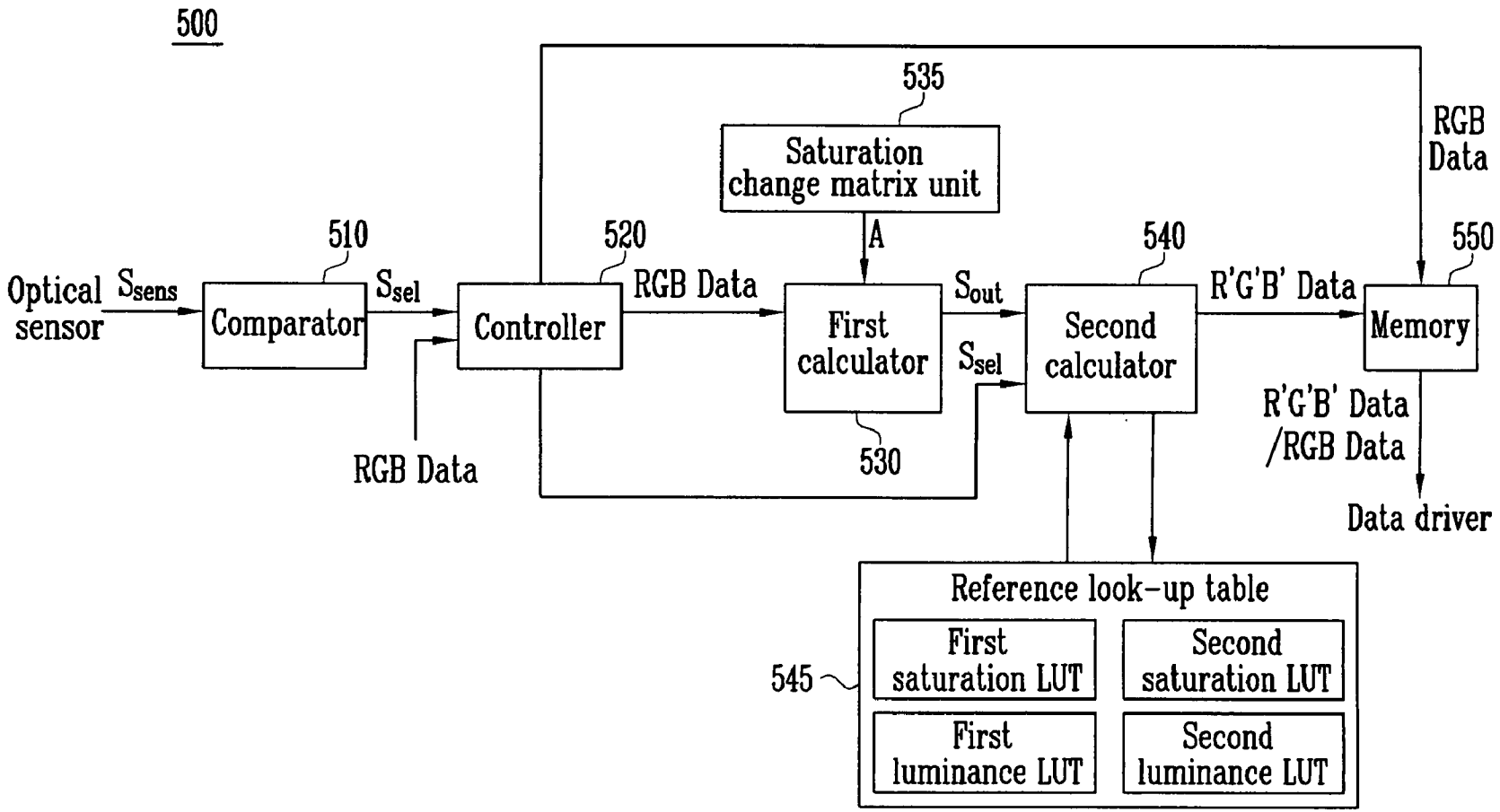
FIG. 6 illustrates a block diagram of the second controller shown in FIG. 1 according to an embodiment.

FIG. 6 illustrates a block diagram of the second controller 500 shown in FIG. 1 according to an embodiment. With reference to FIG. 6, the second controller 500 may include a comparator 510, a controller 520, a first calculator 530, a saturation change matrix unit 535, a second calculator 540, a reference look-up table unit 545, and a memory 550.

The comparator 510 may compare the optical sensing signal Ssens, received from either the optical sensor 800 or the first controller 400, with a previously set reference value and output a selection signal Ssel to select one of at least three modes. In detail, the comparator 510 may set at least three modes based on the reference value corresponding to a magnitude of the optical sensing signal Ssens, and output the selection signal Ssel. For convenience of the description, hereinafter, an embodiment will be explained assuming that the comparator 510 sets three modes in accordance with the optical sensing signal Ssens.

When the optical sensing signal Ssens is within a minimum range above the previously set reference value, i.e., when ambient illumination is within a weakest range, the comparator 510 may set a first mode, in which input image data RGB Data is not changed, and output a corresponding selection signal Ssel. When the optical sensing signal Ssens is within a maximum range above the previously set reference value, i.e., when ambient illumination is strongest, e.g., direct sunlight, the comparator 510 may set a third mode in which a saturation and/or luminance of the input image data RGB Data is maximally changed, and output a corresponding selection signal Ssel.

In a remaining case, i.e., when the optical sensing signal Ssens is between an upper limit of the minimum range and a lower limit of the maximum range above the previously set reference value, e.g., indirect sunlight, the comparator 510 may set a second mode in which the saturation and/or luminance of the input image data RGB Data is changed, and output a corresponding selection signal Ssel. The input image data RGB data may be changed less in the second mode than in the third mode.

In an embodiment, when the ambient luminance is less than the set reference value, the first controller 400 may operate. When the ambient luminance is equal to or greater than the set reference value, the second controller 500 may operate. Accordingly, the second controller 500 may substantially operate in the second mode and the third mode.

The selection signal Ssel output from the comparator 510 may be received by the controller 520. The controller 520 may determine a degree of change, including none, to the input image data RGB Data corresponding to the selection signal Ssel from the comparator 510.

The controller 520 may transfer the input image data RGB Data to the first calculator 530 or store the input image data RGB Data in the memory 450 according to whether the input image data RGB Data is to be changed. For example, when the ambient illumination is within the weakest range above the set reference value, i.e., the first mode is selected, the controller 520 may store the input image data RGB Data in the memory 550. When the second or third mode is selected, the controller 520 may transfer the input image data RGB Data to the first calculator 530 and the selection signal Ssel to the second calculator 540.

The first calculator 530 may generate a pixel saturation data Sout corresponding to the input image data RGB Data from the controller 520 by referring the saturation change matrix unit 535. For example, the first calculator 530 may multiply input data Rin, Gin, and Bin by sub pixels with a saturation change matrix A output from the saturation change matrix unit 535 to obtain saturation data Rs, Gs, and Bs by sub pixels, and may generate the pixel saturation data Sout accordingly. A method for calculating the saturation data Rs, Gs, and Bs by sub pixels will be explained later with reference to FIG. 7A to FIG. 7D.

The pixel saturation data Sout may be calculated from the saturation data Rs, Gs, and Bs by sub pixels. For example, the pixel saturation data Sout may be set to a maximum value among the saturation data Rs, Gs, and Bs by sub pixels or to a predetermined value corresponding to a difference between a maximum value and a minimum value of the saturation data Rs, Gs, and Bs by sub pixels.

The pixel saturation data Sout generated by the first calculator 530 may be output to the second calculator 540. The second calculator 540 may extract the change data R'G'B' Data from the reference look-up table unit 545 corresponding to the pixel saturation data Sout supplied from the first calculator 530, and may store the changed data R'G'B' Data in the memory 550.

In detail, the second calculator 540 may select one of a first saturation and luminance look-up table (LUT) and a second saturation and luminance LUT in the reference look-up table unit 545 in accordance with the selection signal Ssel. Then, the second calculator 540 may extract the changed data R'G'B' Data having saturation and luminance values in accordance with the pixel saturation data Sout from the selected LUTs. The saturation LUT and the luminance LUT are tables having a saturation change value and a luminance change value for each pixel saturation data Sout.

Different saturation and/or luminance values may be stored in the first saturation and luminance LUT and the second saturation and luminance LUT corresponding to the same pixel saturation data Sout. For example, the first saturation and luminance LUT to be selected in the second mode may have lower saturation and/or luminance values stored therein than the second saturation and luminance LUT to be selected in the third mode.

When the pixel saturation data Sout not stored in the reference look-up table unit 545 is input, the second calculator 540 may extract the changed data R'G'B' Data using two values adjacent to the pixel saturation data Sout among values stored in the reference look-up table unit 545. For example, the second calculator 540 may linearly interpolate change values corresponding to a maximum value of values less than input pixel saturation data Sout and a minimum value among values greater than the pixel saturation data Sout in order to extract the changed data R'G'B' Data.

The memory 550 may store the input image data RGB Data from the controller 520 or the changed data R'G'B' Data from the second calculator 540. The input image data RGB Data or the changed data R'G'B' Data stored in the memory 550 may be output to the data driver 300.

FIG. 7A to FIG. 7D illustrate examples of calculating destination saturation data by sub pixels using a saturation change matrix A output by the saturation change matrix unit 535. With reference to FIG. 7A to FIG. 7D, the first calculator 530 may multiply the saturation change matrix A by input data Rin, Gin, and Bin by sub pixels included in the input image data RGB Data to obtain saturation data Rs, Gs, and Bs by sub pixels.

The saturation change matrix A adjusts a saturation using a saturation factor k. The saturation change matrix A may be used to convert values of the input data Rin, Gin, and Bin by sub pixels by a previously set saturation factor k so as to calculate the saturation data Rs, Gs, and Bs by sub pixels.

The saturation change matrix A may be determined in accordance with a white balance of a pixel. A matrix as shown in FIG. 7B is generally used as the saturation change matrix A. Thus, the first calculator 530 may multiply the saturation change matrix A shown in FIG. 7B by input data Rin, Gin, and Bin by sub pixels to obtain the saturation data Rs, Gs, and Bs by sub pixels.

When the saturation factor k is greater than 1, the saturation is increased. When the saturation factor k is less than 1 and greater than 0, the saturation is reduced. When the saturation factor k is less than 0, color may be inverted. When the saturation factor k is 1, since the saturation change matrix A becomes a 3×3 unit matrix, the saturation is not changed.

Moreover, when the saturation factor k is zero, as shown in FIG. 7D, all saturation data Rs, Gs, and Bs by sub pixels equal a white balance. Thus, an image displayed using such saturation data Rs, Gs, and Bs will be monochromatic.

Figure 8:
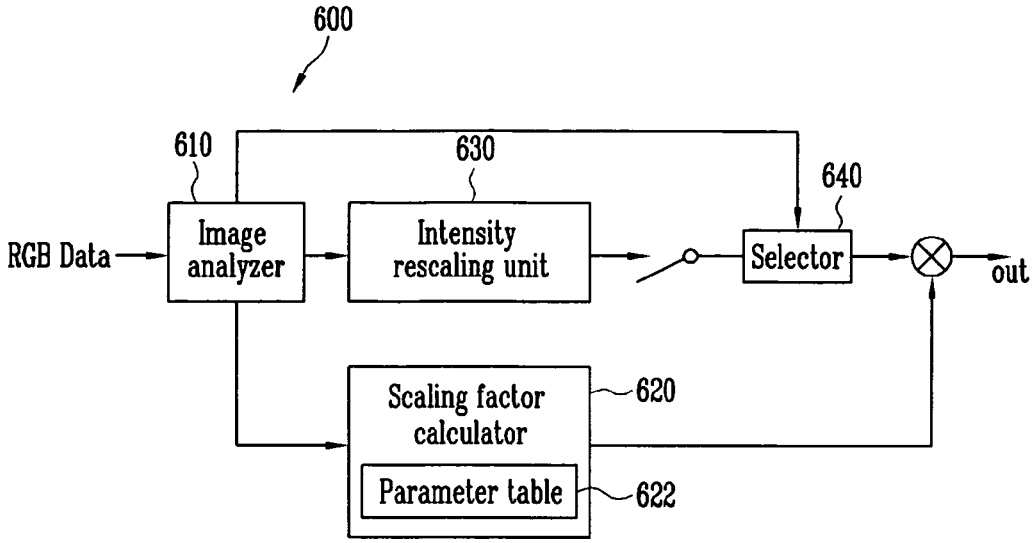
FIG. 8 illustrates a block diagram of the third controller shown in FIG. 1 according to an embodiment.
Figure 9:
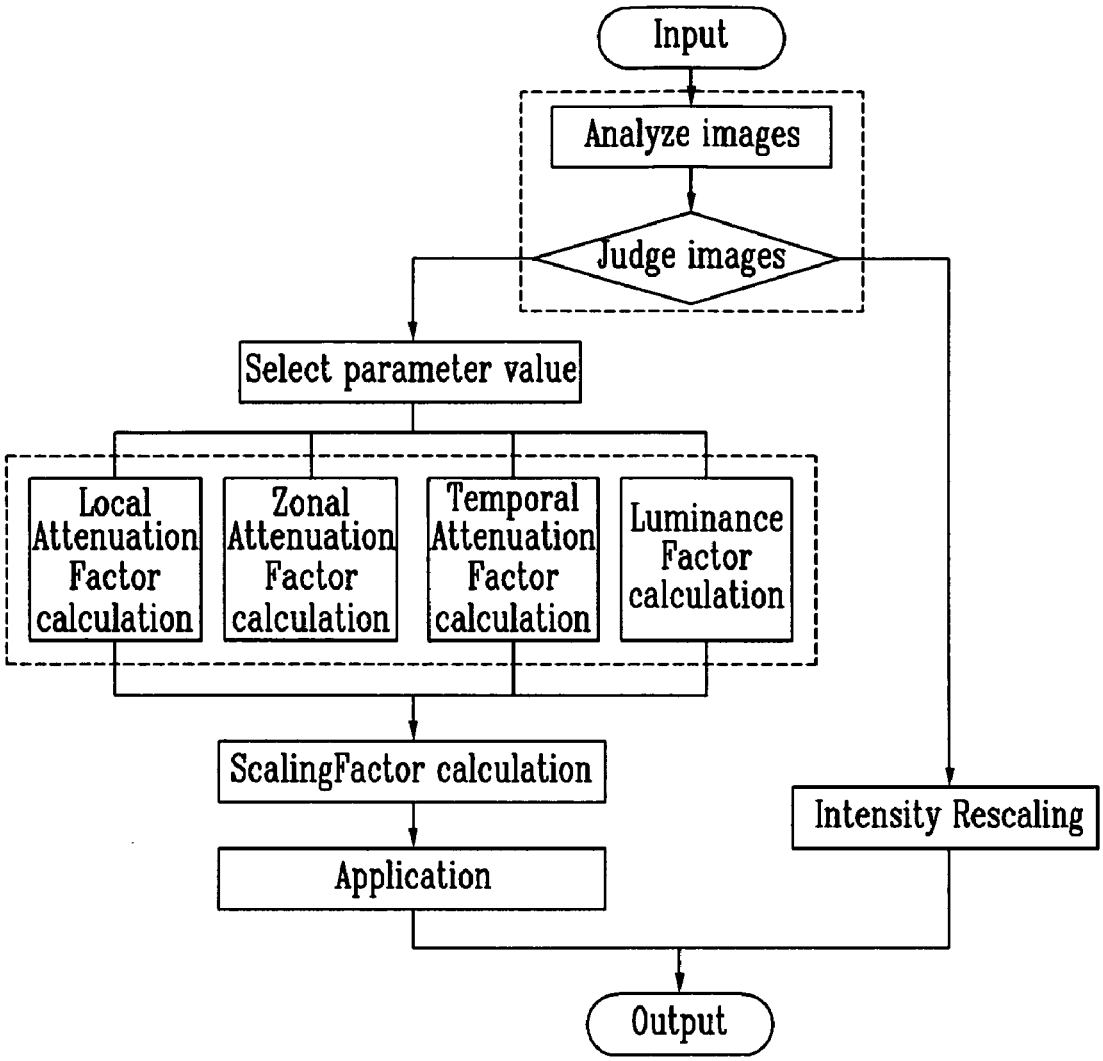
FIG. 9 illustrates a flow chart of an operation of the third controller shown in FIG. 8 according to an embodiment.
Figure 10:
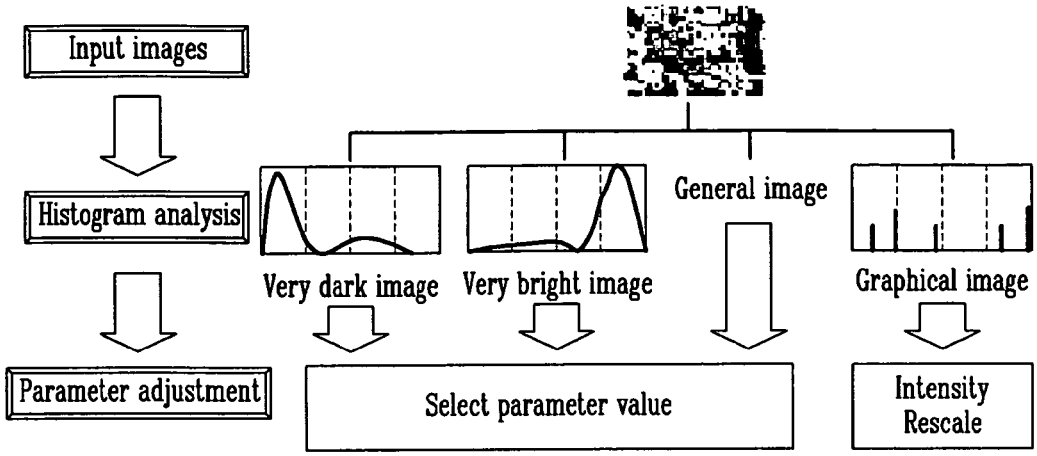
FIG. 10 illustrates a schematic view of an operation of the image analyzer shown in FIG. 8 according to an embodiment.

FIG. 8 illustrates a block diagram of the third controller 600 shown in FIG. 1 in accordance with an embodiment. FIG. 9 illustrates a flow chart of operation of the third controller 600 shown in FIG. 8 in accordance with an embodiment. FIG. 10 illustrates operation of an image analyzer 610 shown in FIG. 8 in accordance with an embodiment.

With reference to FIG. 8, the third controller 600 includes the image analyzer 610, a scaling factor calculator 620, an intensity resealing unit 630, and a selector 640. The scaling factor calculator 620 may include a parameter table 622 that stores a parameter value for determining scale intensity upon calculating a scaling factor.

The image analyzer 610 may analyze the input image data RGB Data. The scaling factor calculator 620 may generate a scaling factor with respect to the input image data RGB Data and produce scaled-down image data. The intensity rescaling unit 630 may adjusting an overall intensity level of the input image data RGB Data.

The selector 640 may select whether or not an output value of the intensity rescaling unit 630 is reflected in a final output of the third controller 600. The image analyzer 610 may control the selector 640. Thus, an output of the scaling factor calculator 620 and/or of the intensity resealing unit 630 may be output from the third controller 600 to the data driver 300 as the image data signal in accordance with operation of the selector 640.

Operation of the third controller 600 in accordance with an embodiment will be explained with reference to FIGS. 8 to 10. The image analyzer 610 may receive and analyze the input image data in terms of type and properties. More specifically, the image analyzer 610 may receive the input image data RGB Data, and may extract luminance components thereof to generate histograms. Luminance components may be extracted from the input image data RGB Data according to Equation 1 below, $$Y=\mathrm{MAX}(R,G,B) \tag{1}$$

where Y indicates luminance and equals a maximum value of R, G, and B data applied to respective sub pixels of a pixel corresponding to the input image data RGB Data. For example, the image analyzer 610 may extract maximum levels of luminance of each of R, G, and B sub pixels of each pixel in the input image data, and may generate a histogram, e.g., a luminance histogram, illustrating brightness and color distribution within the input data image.

Input image data RGB Data may be classified according to the luminance histogram, as, e.g., a very dark image, a very bright image, a general image, and/or a graphical image, as illustrated in FIG. 10. The input image data RGB Data may be transmitted to the scaling factor calculator 620 and/or to the intensity resealing unit 630.

In accordance with image classification, when the image is judged to be one of a very dark image, a very bright image, or a general image, the image data may be transmitted to the scaling factor calculator 620 in order to select parameter values, as indicated in FIG. 9. As illustrated in more detail in FIG. 9, the scaling factor calculator 620 may calculate attenuation factors, calculate a scaling factor, and apply the scaling factor to the input image data. When the image data is judged to be a graphical image, the image data may be transmitted to the intensity rescaling unit 630, as illustrated in FIGS. 8 and 10, in order to scale the intensity of the image data, as indicated in FIG. 9.

The scaling factor calculator 620 of the third controller 600 may receive the input image data RGB Data from the image analyzer 610, and may generate a scaling factor with respect to the image data in accordance with its histogram, e.g., luminance components of the input image data RGB Data, and with respect to conversion parameters in a parameter table 622 of the scaling factor calculator 620. The parameter table 622, e.g., Table 1 below, may include a plurality of conversion parameters, i.e., local, zonal, temporal, and/or gamma parameters, determined according to experimentation and corresponding to the histogram data received from the image analyzer 610. The conversion parameters in the parameter table 622 may be adjusted with respect to a type of display device. Determination of the scaling factor with respect to the histogram data received from the image analyzer 610 and with respect to the parameter table 622 will be discussed in more detail below with reference to FIGS. 11A to 11D.

TABLE 1

| Parameter | General image | Very dark image | Very bright image |
|---|---|---|---|
| Local_Para | 1.3 | 1.3 | 1.3 |
| Zonal_Para | 0.6 | 0.4 | 0.6 |
| Temporal_Para | 1.1 | 1.1 | 1.1 |
| Gamma_Para | 1.3 | 1.1 | 1.1 |

The intensity rescaling unit 630 of the third controller 600 may receive the histogram data from the image analyzer 610, and may rescale intensity of the input image data accordingly. For example, the intensity rescaling unit 630 may receive the graphic image from the image analyzer 610, as illustrated in FIG. 10, and may reduce an overall luminance, i.e., reduce intensity of each pixel, thereof with respect to the luminance distribution pattern in the histogram.

The selector 640 may control transmittance of an output value of the intensity rescaling unit 630, i.e., an input image data with rescaled intensity. For example, the selector 640 may control output of the intensity rescaling unit 630, e.g., operate a relay between the intensity rescaling unit 630 and an output of the third controller 600, so the input image data with rescaled intensity may be blocked or transmitted as an output of the third controller 600. The selector 640 may be controlled by the image analyzer 610 with respect to a type of the input image data.

Referring to FIG. 10, the image analyzer 610 may analyze the input image data RGB Data according to luminance features thereof. For example, as illustrated in FIG. 10, the image analyzer 610 may generate a histogram representing whether the input image data is a very dark image, a very bright image, a general image, and/or a graphic image. As further illustrated in FIG. 10, a histogram of a graphic image, e.g., data such as games, maps, and/or texts, may include a relatively large number of bins, i.e., columns representing intensities of pixels, so the graphic image may be transferred to the intensity rescaling unit 630 to reduce an overall intensity level thereof via adjustment of pixel intensity. The remaining image types, i.e., the very dark image, the very bright image, and the general image, may be transferred to the scaling factor calculator 620 to determine conversion parameters from the parameter table 622 and respective attenuation factors. The graphic image maybe scaled via the intensity rescaling unit 630, instead of the scaling factor calculator 620, because extraction of luminance features from a graphic images for calculating a corresponding scaling factor may be complex, and may result in an inadequate minimized image data.

Determination of conversion parameters and respective attenuation factors may be determined according to luminance features in the histogram data, as will be explained in more detail below with reference to FIGS. 11A-11D. Image data received from the image analyzer 610 may be analyzed to extract luminance features, such as data regarding gradient magnitude of a pixel corresponding to input image data, i.e., a rapid occurrence degree of a brightness difference, spatial location of the pixel, speed between frames of the pixel, and luminance level of the pixel. Each extracted luminance feature may be used in conjunction with a corresponding conversion parameter to generate a respective attenuation factor. The respective attenuation factors may be used to generate the scaling factor.

FIG. 11A to FIG. 11D illustrate relationships between respective features and a scale ratio with respect to respective scale factors shown in FIG. 9.

First, a gradient magnitude of a pixel corresponding to input image data, i.e., a dramatic delta in brightness or contours in the image, may be obtained by extracting high frequency components of the image data.

$$I_{(x,y)}-\mathrm{LPF}_{(x,y)} \tag{2}$$

where, $I_{(x,y)}$ is an intensity of a pixel corresponding to the input image data, and $\mathrm{LPF}_{(x,y)}$ is an intensity of a pixel after low-pass filtering. The result of equation (2) provides a high frequency component of the pixel, which may be scaled by a scaling ratio between one and zero.

Figure 11A:
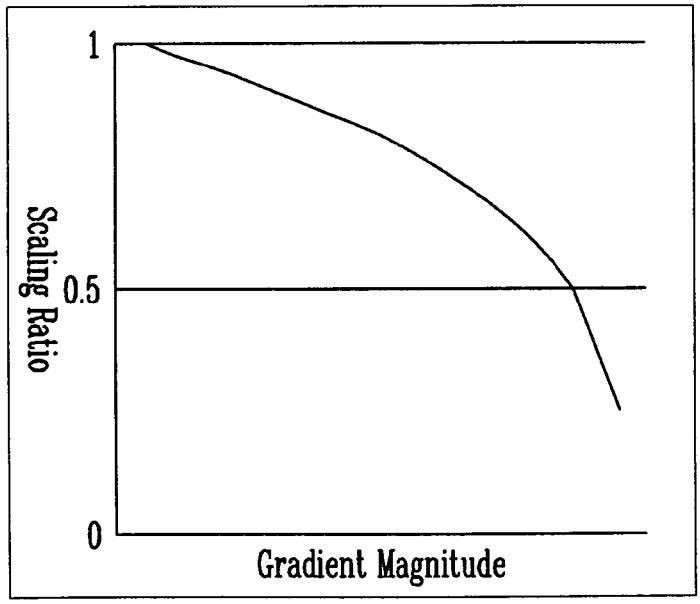
FIG. 11A to FIG. 11D illustrate graphs of scale ratios with respect to gradient magnitude, pixel locations, speed between frames, and luminance, respectively.

As shown in FIG. 11A, when a gradient magnitude increases, i.e., more high frequency components are in the image data of the pixel, the scaling ratio may decrease. Thus, a signal level in a region having many edges, i.e., high frequency components, may be reduced relative to a signal level in a region having fewer edges. In other words, a high local attenuation factor corresponds to low gradient magnitude, i.e., a high frequency component having a low value. Accordingly, when the input image data has an increased high frequency component, i.e., high gradient magnitude, the scaling ratio may be decreased.

The high frequency component may be normalized via use of a local_para parameter from the parameter table 622, e.g., 1.3 from Table 1, to generate a local attenuation factor having a value on a scale between zero and one. An intensity of the input image data may be adjusted for each pixel by multiplying the intensity of the input data image by the local attenuation factor, as illustrated in Equation 3 below, where $I'_{(x,y)}$ refers to the adjusted intensity value, and local_para refers to a parameter from the parameter table 622 having a predetermined constant value.

$$I'_{(x,y)} = \frac{(I_{(x,y)} - LPF_{(x,y)})^{local_para}}{I_{(x,y)} - LPF_{(x,y)}} \cdot I_{(x,y)} \tag{3}$$

Data regarding a spatial location of each pixel, i.e., a spatial attenuation parameter, may be obtained by extracting x and y coordinates for each pixel in the input image data by the image analyzer 140. For example, an upper left-hand corner of the display panel 100 may have a coordinate value of [x, y]=[0, 0], and a lower right-hand corner of the display panel 100 may have a coordinate value of $[x, y]=[x_1, y_1]$, where $x_1$ may indicate a width of an image, and $y_1$ may indicate a height of an image. The coordinates of each pixel may be used with a zonal_Para parameter from the parameter table 622, e.g., 0.6 from Table 1 for a general image or a very bright image, or 0.4 from Table 1 for a very dark image, to generate a zonal attenuation factor having a value on a scale between zero and one. An intensity of the input image data may be adjusted for each pixel by multiplying the intensity of the input data image by the zonal attenuation factor, as illustrated in Equation 4 below, where $x_1$ and $y_1$ refer to width and height of an image, respectively, and zonal_para refers to a parameter from the parameter table 422 having a predetermined constant value. The zonal attenuation factor may be obtained by an approximated Gaussian function.

$$I'_{(x,y)} = \left[1 - \left\{\text{Zonal_Para}\frac{\left(x - \frac{1}{2}\cdot\text{Width}\right)^2 + \left(y - \frac{1}{2}\cdot\text{Height}\right)^2}{\text{Width}\cdot\text{Height}}\right\}\right]\cdot I_{(x,y)} \tag{4}$$

Figure 11B:
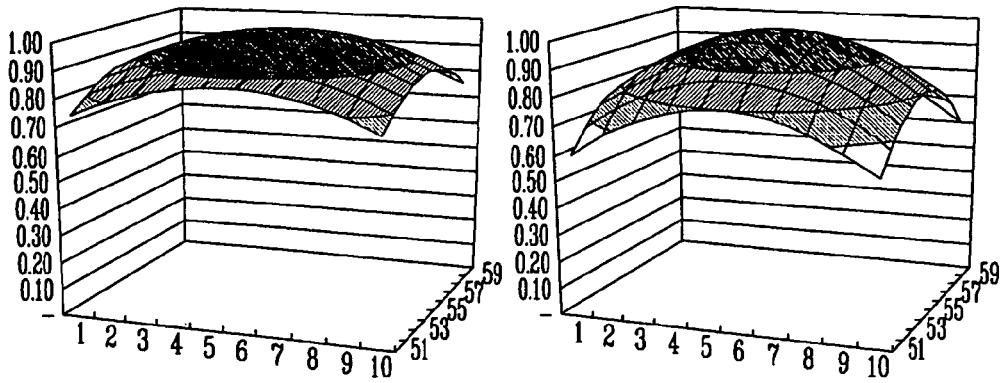

The zonal attenuation factors of peripheral pixels in the pixel unit 100 may be lower as compared to zonal attenuation factors of central pixels of the pixel unit 100, so intensity in the peripheral pixels may be reduced more than intensity in the central pixels. For example, as illustrated in FIG. 11B, a mapped input image data according to x and y coordinates may have adjusted intensity levels along the z-axis, i.e., zonal attenuation factor. As illustrated in graphs (a) and (b) of FIG. 11B, a center of an image may have an adjusted intensity value substantially equal to the input intensity value, i.e., the zonal_para may be substantially zero. However, as further illustrated in graphs (a) and (b) of FIG. 11B, peripheral portions of the image may have zonal attenuation factors of about 0.5 or about 0.8, respectively, with an increasing zonal_para further reducing intensities.

Data regarding speed between frames of a pixel corresponding to the input image data, i.e., a temporal attenuation parameter, may be obtained by comparing pixel intensities of two continuous frames, where a frame having a greater pixel value may be regarded as a faster frame. For example, Diff, a difference between pixel intensities of frames, may be calculated according to Equation 5 below, where $I^n$ indicates a current frame and $I^{n-1}$ indicates a previous frame. A pixel in a sub-window of 5×5 may be used as an example.

$$Diff = \frac{\sum_i^{5\times5} I_i^{n-1}}{\sum_i^{5\times5} I_i^{n}} \tag{5}$$

Accordingly, when there are large changes of intensity on a pixel between frames, the temporal attenuation factor increases a reduction degree of a signal level.

Figure 11C:
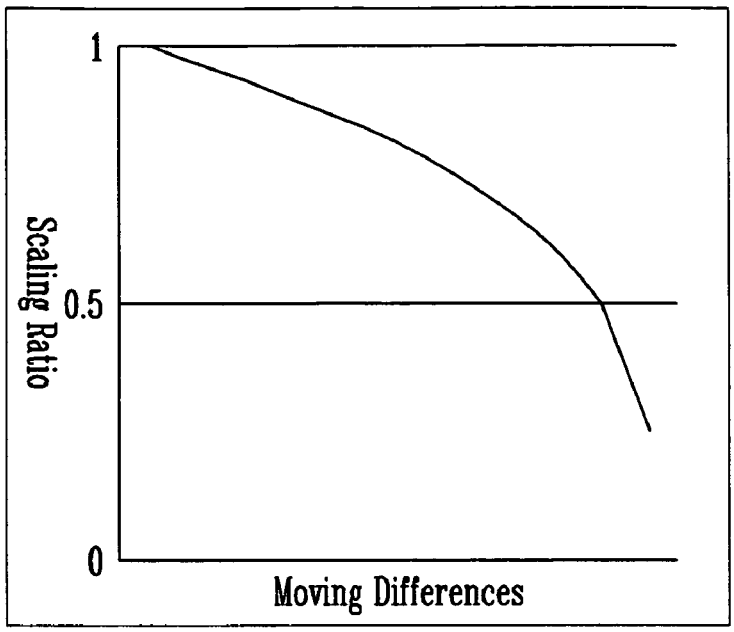

FIG. 11C shows a correlation curve between the moving difference and the scaling ratio. A reduction degree of a signal level is increased at a boundary part of a rapidly moving image on a real moving image.

The difference between pixel intensities of frames, i.e., Diff, may be normalized to provide a temporal attenuation factor having a value between zero and one. For example, when an extracted value Diff is less than zero, the intensity of the pixel may be multiplied by (−1), and when an extracted value Diff is greater than 1, the intensity of the pixel may be cut-off at 1 to provide a value between zero and one. In other words, Diff may be normalized via use of a temporal_para parameter from the parameter table 422, e.g., 1.1 from Table 1, to generate a temporal attenuation factor having a value on a scale between 0 and 1. The intensity of the input data image may be adjusted for each pixel by multiplying the intensity of the input data image by the temporal attenuation factor, as illustrated in Equation 6 below, where temporal_para refers to a parameter from the parameter table 422 having a predetermined constant value.

$$I'_{(x,y)} = \frac{Diff^{temporal_Para}}{Diff} \cdot I_{(x,y)} \tag{6}$$

When the difference between the pixel frames is large, the temporal attenuation factor may be low to increase a degree of reduction of the input image data, as illustrated in FIG. 11C. For example, a scaling of the input image data may be decreased at a boundary between a rapidly moving image and a slow moving image.

Figure 11D:
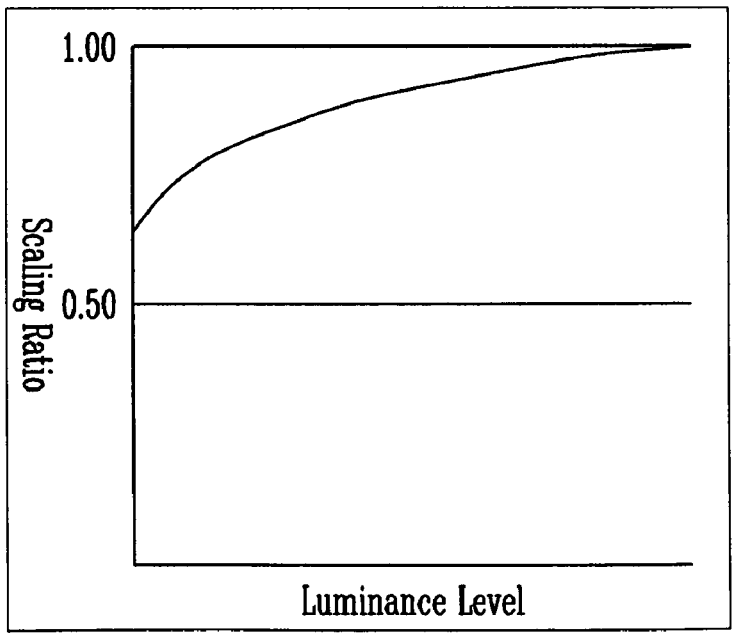

Data regarding luminance of a pixel corresponding to the input image data, i.e., a gamma attenuation parameter, may be obtained by determining light emission intensity of the input image data. When the intensity level of the pixel is low, a luminance factor may increase a reduction degree of a signal level. For example, as illustrated in FIG. 11D, a pixel of a bright region may have a compressed intensity that is lower than that of a pixel of a dark region. The luminance factor and a corresponding adjusted intensity may be obtained according to Equations 7-8 below, respectively.

Here, $I'_{(x,y)}$ is a rescaled value. Also, temporal_para is a constant number for determining the intensity of scaling as a parameter value from the Table 1, and uses a predetermined value.

$$LumiFactor = \frac{I_{(x,y)}^{temporal_Para}}{I_{(x,y)}} \quad (7)$$

$$I'_{(x,y)} = I_{(x,y)}^{temporal_Para} \quad (8)$$

When respective features are extracted from the input image data and different scaling factors are obtained using the extracted features, a final scaling factor applied to a final output image may be calculated as the product of respective scaling factors, namely, a local attenuation factor, a zonal attenuation factor, a temporal attenuation factor, and a luminance factor.

The final scaling factor may be applied to the input image data RGB Data to regenerate and display an image using low power consumption while minimizing image quality degradation. More specifically, the input image data RGB Data may be scaled down, so image quality may be minimally degraded even while reducing power consumption. Accordingly, display quality and power reduction may be maximized.

The second controller 500 and the third controller 600 may operate at different times. Accordingly, only one of the changed data R'G'B' Data output by the second controller 500 or the scaled data R"G"B" Data output by the third controller 600 may be provided to the data driver 300. For example, the third controller 600 may operate in accordance with a user input request to preserve power and/or after a period of inactivity, with the second controller 500 operating otherwise.

Figure 12:
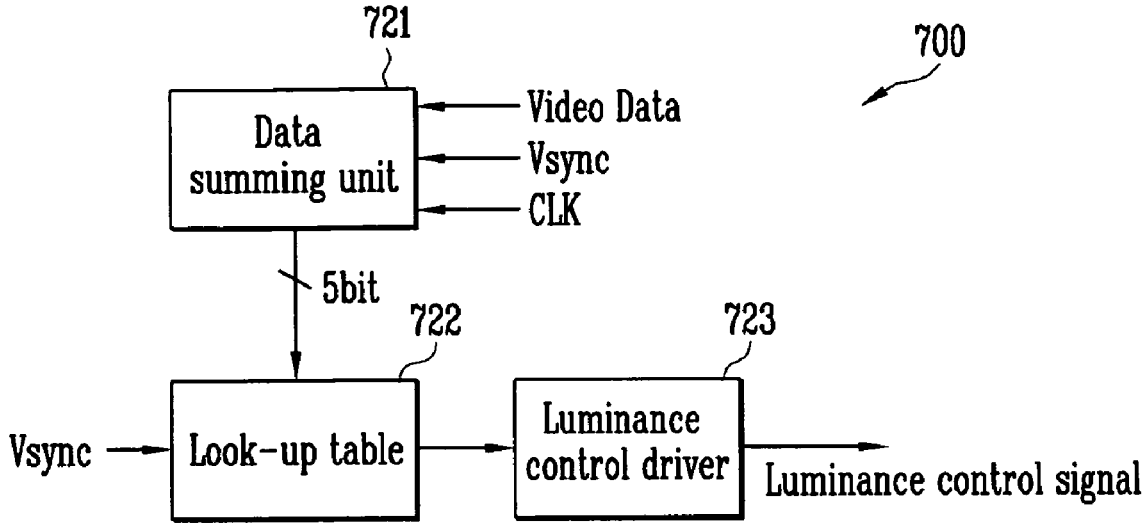
FIG. 12 illustrates a block diagram of the fourth controller shown in FIG. 1 according to an embodiment.

FIG. 12 illustrates a block diagram showing the fourth controller 700 shown in FIG. 1 according to an embodiment. The fourth controller 700 functions to control a brightness of the pixel unit 100 according to an emission rate thereof. The fourth controller 700 may include a data summing unit 721, a look-up table 722, and a luminance control driver 723.

The data summing unit 721 may generate a magnitude of a frame data, i.e., a sum of video data input to pixels 110 emitting light during one frame. The sum of video data input to pixels 110 emitting light during one frame is referred to as 'frame data'. When the magnitude of the frame data is great, the emission rate of the pixel unit 100 is high or there are many pixels 110 expressing images of a high gradation.

When the frame data is great, a lot of current is flowing through the pixel unit 100. Accordingly, when the magnitude of the frame data is equal to or greater than a predetermined value, the luminance of the pixel unit 100 may be controlled to reduce the entire brightness of the pixel unit 100. When the brightness of the pixel unit 100 is reduced, a pixel 110 emitting light has a high luminance to maintain a high luminance difference with a pixel not emitting light, i.e., a high contrast ratio.

On the other hand, when the brightness of the pixel unit 100 is not reduced, an emission time of pixels 110 emitting light may have to be lengthened to increase the luminance. This may limit a contrast ratio between pixels 110 emitting light and pixels 110 not emitting light. That is, in accordance with embodiments, the contrast ratio between pixels 110 emitting light and pixels 110 not emitting light may be increased so that the images may be clearly viewed.

The look-up table 722 may store information about a ratio of an emission period and a non-emission period of an emission control signal corresponding to an upper 5 bit value of the frame data. The brightness of the pixel unit 100 emitting light during one frame may be determined using the information stored in the look-up table 722.

When the magnitude of the frame data is equal to or greater than a predetermined value, the luminance control driver 723 may output a luminance control signal, and adjust the ratio of an emission period and a non-emission period of the emission control signal input to the pixel unit 100. When a luminance control ratio is continuously increased proportional to an increase in the luminance of the pixel unit 100 and the luminance of the pixel unit 100 is very high, a sufficiently bright screen may not be provided due to an excessive luminance control. This may lead to the deterioration of an entire brightness. Accordingly, a maximal control range of the luminance may be set to suitably adjust the entire brightness of the pixel unit 100.

FIG. 13 is a table showing an example of the look-up table 722 shown in FIG. 12. FIG. 13 shows the look-up table 722 in which an emission ratio is limited to 50% of a maximum value according to the luminance of the pixel unit 100.

With reference to FIG. 13, when a rate of an emission region of the pixel unit 100 is less than 36% of a total pixel unit 100, the luminance of the pixel unit 100 is not limited. When a rate of an emission region of the pixel unit 100 is equal to or greater than 36% of a total pixel unit 100, the luminance of the pixel unit 100 is limited. When an area in which the pixel unit 100 emits light with the maximum luminance is increased, a limit ratio of the luminance is also increased. A ratio of an emission area is a variable determined by a following equation 9.

$$\text{Emission ratio} = \frac{\textit{lum.}\ \text{of a pixel portion emmiting light during one frame}}{\textit{lum.}\ \text{of a pixel portion emmiting light with entire white}} \quad (9)$$

Further, so as to prevent excessively limiting of the luminance, a maximum limit ratio may be limited, e.g., to 50%. Accordingly, when most of the pixels 110 emit light with a maximum luminance, the luminance limit ratio remains at about 50%.

As is seen from the forgoing description, according to embodiments, a display may have its luminance adjusted according to ambient light and/or according to an emission amount of a pixel unit, so as to improve the visibility and/or to reduce power consumption. The power consumption reduction may be realized without significantly influencing the image quality through scaling of the input image data. Accordingly, image quality and power reduction may be maximized.

Furthermore, input image data may be changed in accordance with an ambient environment, such as the intensity of ambient light, in order to enhance the visibility. In particular, when a display is exposed to ambient light greater than a predetermined illumination, changed image data may be generated and a corresponding image may be displayed, so that the visibility may be improved, e.g., even under direct sunlight. The changed data may be obtained by increasing saturation of the input image data.

In addition, when changed data is generated, one of at least two modes to change input image data may be used. The at least two modes may be defined in accordance with the intensity of ambient light, and may alter the saturation of the input image data accordingly.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a pixel unit including a plurality scan lines configured to provide scan signals, a plurality of emission control lines configured to provide emission control signals, a plurality of data lines configured to provide data signals, and a plurality of pixels coupled to the scan lines, the emission control lines, and the data lines;

a scan driver configured to sequentially generate and apply the scan signals and the emission control signals to the plurality of scan lines;

a data driver configured to generate and apply the data signals to the data lines;

an optical sensor configured to generate an optical sensing signal corresponding to an intensity of ambient light;

a first controller configured to select a gamma value corresponding to the optical sensing signal, and output a gamma compensation signal corresponding to the selected gamma value to control a gradation voltage of the data signal;

a second controller configured to compare the optical sensing signal with a previously set reference value, generate a selection signal in response thereto, and provide changed image data to the data driver, the changed data being obtained by changing input image data in accordance with the selection signal;

a third controller configured to obtain and apply a scaling factor to the input image data through extracted features related to the input image data and a scale ratio obtained from the extracted features, and provide scaled image data to the data driver; and a fourth controller configured to provide a luminance control signal for controlling a pulse width of the emission control signal to the scan driver.

2. The organic light emitting display as claimed in claim 1, wherein according to an intensity of the ambient light sensed by the optical sensor, the first controller operates when the ambient light has an intensity less than the reference value, and the second controller operates when the ambient light has an intensity equal to or greater than the reference value.

3. The organic light emitting display as claimed in claim 1, wherein the data driver receives the image data converted by one of the first controller, the second controller and the third controller to generate data signals corresponding to the image data, and transfers the generated data signals to the data lines.

4. The organic light emitting display as claimed in claim 1, wherein only one of the changed image data from the second controller and the scaled image data from the third controller is selected and provided to the data driver.

5. The organic light emitting display as claimed in claim 1, wherein the first controller comprises:

an analog-digital converter configured to convert an analog sensing signal output from the optical sensor into a digital sensing signal;

a counter configured to generate a counting signal during one frame period;

a conversion processor configured to output a control signal in accordance with the digital sensing signal and the counting signal;

a register generator configured to classify the digital sensing signal into a plurality of states and store a plurality of set values corresponding to respective states;

a first selector configured to select and output one of the plurality of set values stored in the register generator in accordance with the control signal output by the conversion processor; and a gamma compensation circuit configured to generate a gamma compensation signal according to the one of the plurality of set values output from the first selector.

6. The organic light emitting display as claimed in claim 5, wherein the first controller further comprises a second selector configured to control an operational state of the first controller.

7. The organic light emitting display as claimed in claim 1, wherein the second controller comprises:

a comparator configured to compare the optical sensing signal with a previously set reference value and output a selection signal for selecting one of at least three modes;

a controller configured to determine, in accordance with the selection signal, whether the input image data is to be changed;

a first calculator configured to generate pixel saturation data corresponding to the input image data received from the controller;

a second calculator configured to extract changed data in accordance with the pixel saturation data and the selection signal; and a memory configured to store the input image data received from the controller or the changed data supplied from the second calculator.

8. The organic light emitting display as claimed in claim 7, wherein the first calculator is configured to generate the pixel saturation data using a saturation change matrix.

9. The organic light emitting display as claimed in claim 8, wherein the first calculator calculates input data by sub pixels included in the input image data and the saturation change matrix to obtain destination saturation data by sub pixels, and generates the pixel saturation data using the destination saturation data.

10. The organic light emitting display as claimed in claim 7, further comprising a reference look-up table unit referred by the second calculator and including first and second saturation and luminance look-up tables.

11. The organic light emitting display as claimed in claim 10, wherein the second calculator is configured to select one of saturation and luminance look-up tables in accordance with the pixel saturation data and the selection signal, and extract the changed data from the selected look-up tables.

12. The organic light emitting display as claimed in claim 1, wherein the third controller comprises:

an image analyzer adapted to analyze input image data;

a scaling factor calculator adapted to generate a scaling factor with respect to the analyzed input image data, and to apply the scaling factor to the input image data to generate a scaled-down image data; and an intensity resealing unit adapted to reduce an overall intensity level of the input image data.

13. The organic light emitting display as claimed in claim 12, wherein the scaling factor calculator includes a parameter table, which stores a parameter value for determining scale intensity upon calculating a scaling factor.

14. The organic light emitting display as claimed in claim 12, further comprising a selector configured to selectively transmit an output of the intensity rescaling unit.

15. The organic light emitting display as claimed in claim 12, wherein the image analyzer is configured to extract luminance components from the input image data to generate a histogram.

16. The organic light emitting display as claimed in claim 15, wherein the image analyzer is configured to transmit the histogram from the image analyzer to the intensity scaling unit and to the scaling factor calculator.

17. The organic light emitting display as claimed in claim 16, wherein the intensity rescaling unit rescales a total intensity of images based on a distribution pattern of the histogram, and the scaling factor calculator uses the histogram information as a source of a parameter selection influencing each scaling factor.

18. The organic light emitting display as claimed in claim 1, wherein the fourth controller comprises:

a data summing unit configured to sum input image data during one frame period to generate a frame data;

a look-up table configured to store information about a luminance control of the pixel unit according to a magnitude of the frame data; and a luminance control driver configured to output the luminance control signal in accordance with the information stored in the look-up table to adjust a ratio of an emission period and a non-emission period of the emission control signal.

19. A control system for use with a display driven by a data signal and an emission control signal, the control system comprising:

an optical sensor configured to generate an optical sensing signal corresponding to an intensity of ambient light;

a first controller configured to select a gamma value corresponding to the optical sensing signal, and output a gamma compensation signal corresponding to the selected gamma value to control a gradation voltage of input image data;

a second controller configured to compare the optical sensing signal with a previously set reference value, generate a selection signal in response thereto, and provide changed image data as the data signal, the changed data being obtained by changing input image data in accordance with the selection signal;

a third controller configured to obtain and apply a scaling factor to the input image data through extracted features related to the input image data and a scale ratio obtained from the extracted features, and output scaled image data as the data signal; and a fourth controller configured to provide a luminance control signal for controlling a pulse width of the emission control signal.

20. A method of controlling a display driven by a data signal and an emission control signal, the method comprising:

generating an optical sensing signal corresponding to an intensity of ambient light;

selecting a gamma value corresponding to the optical sensing signal, and outputting a gamma compensation signal corresponding to the selected gamma value to control a gradation voltage of input image data;

comparing the optical sensing signal with a previously set reference value, generating a selection signal in response thereto, and providing changed image data as the data signal, the changed data being obtained by changing input image data in accordance with the selection signal;

obtaining and applying a scaling factor to the input image data through extracted features related to the input image data and a scale ratio obtained from the extracted features, and outputting scaled image data as the data signal; and controlling a pulse width of the emission control signal.

* * * * *